US007711557B2

(12) United States Patent
Ozawa

(10) Patent No.: US 7,711,557 B2
(45) Date of Patent: May 4, 2010

(54) AUDIO SIGNAL NOISE REDUCTION DEVICE AND METHOD

(75) Inventor: Kazuhiko Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 743 days.

(21) Appl. No.: 11/604,403

(22) Filed: Nov. 27, 2006

(65) Prior Publication Data

US 2007/0150261 A1 Jun. 28, 2007

(30) Foreign Application Priority Data

Nov. 28, 2005 (JP) ..... 2005-342521

(51) Int. Cl.
*G10L 704/226* (2006.01)

(52) U.S. Cl. ..... 704/226

(58) Field of Classification Search ..... 704/226–228
See application file for complete search history.

(56) References Cited

U.S. PATENT DOCUMENTS 5,341,457 A * 8/1994 Hall et al. ..... 704/226
5,535,300 A * 7/1996 Hall et al. ..... 704/227
5,742,928 A * 4/1998 Suzuki ..... 704/239
5,794,187 A * 8/1998 Franklin et al. ..... 704/225
5,909,663 A * 6/1999 Iijima et al. ..... 704/226
6,055,497 A * 4/2000 Hallkvist et al. ..... 704/228
6,862,558 B2 * 3/2005 Huang ..... 702/194
7,272,556 B1 * 9/2007 Aguilar et al. ..... 704/230
7,454,330 B1 * 11/2008 Nishiguchi et al. ..... 704/224

FOREIGN PATENT DOCUMENTS

| | | |
|---|---|---|
| JP | 9 6397 | 1/1997 |
| JP | 10 111699 | 4/1998 |
| JP | 2002 251823 | 9/2002 |
| JP | 2002-268696 | 9/2002 |
| JP | 2003-223198 | 8/2003 |
| JP | 2004-138756 | 5/2004 |
| JP | 2004-138789 | 5/2004 |
| JP | 2005 303681 | 10/2005 |

* cited by examiner

*Primary Examiner*—Michael N Opsasnick
(74) *Attorney, Agent, or Firm*—Frommer Lawrence & Haug LLP; William S. Frommer

(57) ABSTRACT

An audio signal reduction device that generates a gap period in accordance with a noise generation period of noise included in an input audio signal. Noise is removed from the audio signal, and the level envelope of the audio signal is continuously detected. A coefficient for the level envelope in the gap period is generated in accordance with the level envelope detection and is used to modulate an interpolated signal. The noise-removed audio signal and the modulated interpolated signal are mixed; and the mixed signal is output in a period corresponding to the gap period, while the audio signal is output, as is, not in the gap period.

12 Claims, 9 Drawing Sheets

FIG. 2
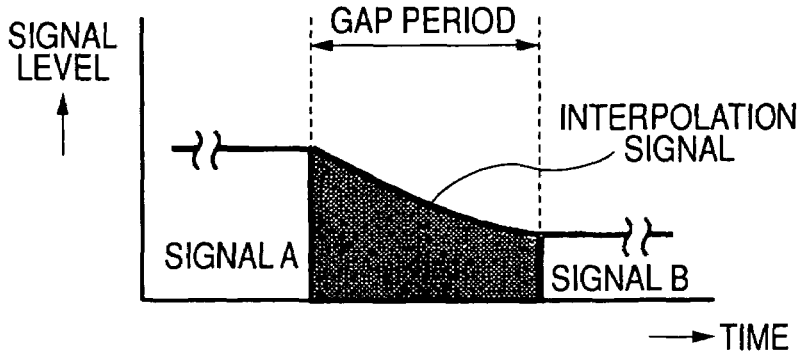
FIG. 3
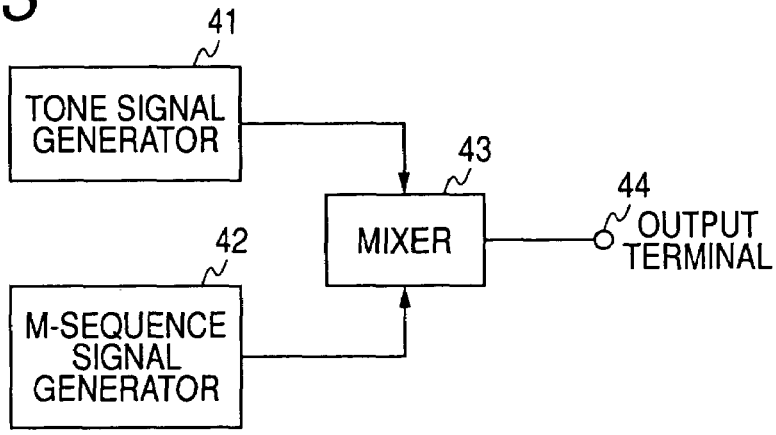
FIG. 4A
FIG. 4B
FIG. 4C
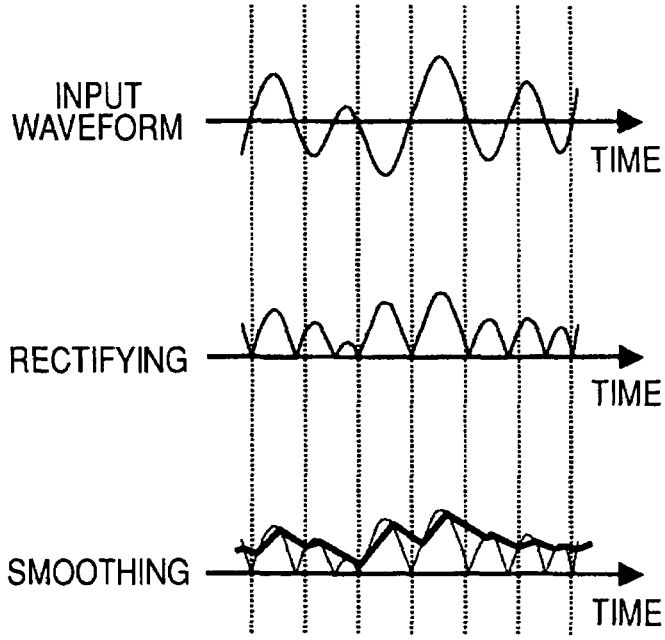

FIG. 8
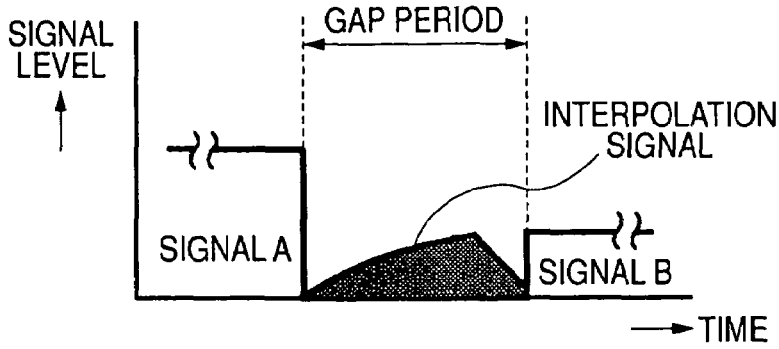
FIG. 9A
FIG. 9B
FIG. 9C
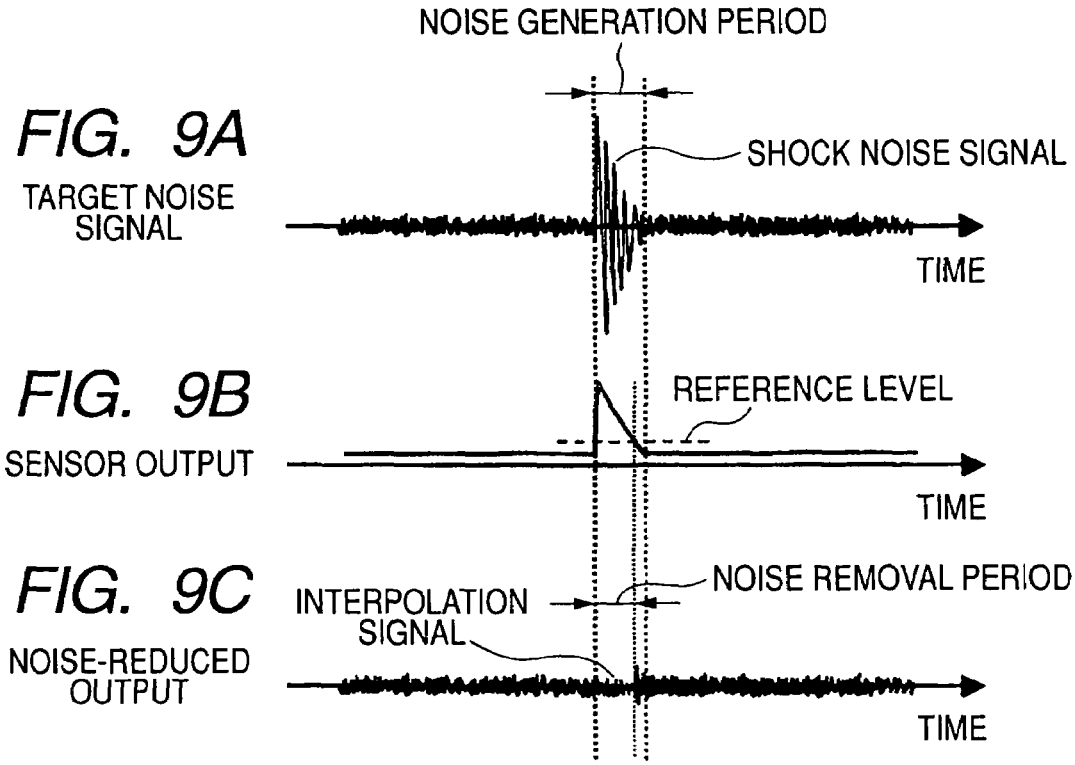

AUDIO SIGNAL NOISE REDUCTION DEVICE AND METHOD

CROSS REFERENCES TO RELATED APPLICATIONS

The present invention contains subject matter related to Japanese Patent Application JP 2005-342521 filed in the Japanese Patent Office on Nov. 28, 2005, the entire contents of which being incorporated herein by reference.

BACKGROUND OF THE INVENTION

1. Field of the Invention

The invention relates to an audio signal noise reduction device that is equipped in a digital private electrical appliance, for example, and reduces the noise level of an audio signal captured by a small-sized microphone, and an audio signal noise reduction method.

2. Description of the Related Art

Digital private electrical appliances each including therein a small-sized microphone, e.g., video cameras, digital cameras, and IC recorders, are becoming increasingly smaller in size. Such a smaller-sized appliance often causes problems of arising unpleasant shock noise, touch noise, or click noise at the time of audio reproduction. Such noise is caused by frequent accidental touch on a microphone and therearound at the time of capturing audio, or click operations of various function switches SW, resulting in the noise entering the microphone after being transmitted through a cabinet. There is another problem caused by the proximity between the internal microphone and a recording device, e.g., tape unit and disk unit, equipped in the private electrical appliance. Such proximity possibly causes noise of the recording device, e.g., vibration noise and acoustic noise, to enter the microphone.

For the aim of reducing such noise, in the internal microphone, a microphone unit is made to be suspended using an insulator such as rubber damper, or the microphone unit is made to be floated using a rubber wire or others. With such a configuration, any vibration coming from the cabinet is absorbed so that no noise is transmitted to the microphone unit. However, this configuration is not enough to achieve the vibration-free environment, i.e., the insulator does not work right if with strong vibration or some vibration frequency, or the resonant vibration occurs with some unique frequency. As such, designing such a configuration is difficult, being the factors that have been hindering the cost saving or size reduction.

For betterment, various other noise reduction methods have been proposed, however, none is satisfactory in terms of meeting users' asking level. This is because the above-described noise includes not only the vibration noise coming from the cabinet but also the acoustic noise that is transmitted as sound in air together with the vibration. Such a noise complicates the transmission path of the noise toward the microphone unit, thereby resulting in a limitation of noise reduction with the previous passive methods.

For the same purpose, the applicant of the invention has proposed the noise reduction technology in Patent Document 1 (JP-A-2005-57437; Microphone Unit, Noise Reduction Method, and Recording Device). In Patent Document 1, the noise reduction is implemented by generating a pseudo noise signal using an adaptive filter, and subtracting the pseudo noise signal from a noise-included audio signal.

SUMMARY OF THE INVENTION

The concern here is that, in the technology in Patent Document 1, the larger bandwidth any pseudo-noise signal has, or the longer the time of a successive segment gets, the larger number of taps the adaptive filter for use for the noise reduction shows the tendency of requiring. In an exemplified case of appropriating a noise waveform of 10 mS segment in a band up to a Nyquist rate with a sampling frequency of 48 kHz, required is an adaptive filter of about 480 taps. This resultantly arises a need for a several-fold number of product-sum operation per sample compared with for the number of taps, thereby resulting in the increase of the scale of the operation. This also arises a need for hardware including a large-sized logic circuit and a high-speed DSP (Digital Signal Processor), for example. Since the time delay caused by the operation cannot be neglected, and the audio signals have to be delayed at the same time, the audio capturing often fails to be done in real time.

The above-described noise, i.e., shock noise, touch noise, or click noise, is not always generated continuously but generated only with any accidental shock. The most noise is thus generated abruptly in the time range of about several mS to several tens of mS. The applicant of the invention has thus proposed, in JP-A-2005-303681 entitled "Noise Reduction Method and Device", to utilize a masking phenomenon observed in the human sense of hearing to perform noise reduction effectively.

Described now is the masking phenomenon observed in the human sense of hearing. The human being hears no small sound behinda relatively large sound, e.g., people find it difficult to hear any human voice in noisy environment. This is referred to as a masking phenomenon, and has been under study for a long time. Although with some findings that the phenomenon is dependent on the characteristics, e.g., frequency component, sound pressure level, and time of duration, the in-depth mechanism is still under study.

Such a hearing masking phenomenon is broadly grouped under frequency masking and time masking, and the time masking is grouped under simultaneous masking and non-simultaneous masking (referred also to as temporal masking). Such a masking phenomenon is currently utilized for high efficiency coding of compressing an audio signal of a CD (Compact Disk) down to ⅕ to 1/10, for example.

By referring to FIGS. 11A and 11B, described now is the non-simultaneous masking phenomenon that is mainly adopted in JP-A-2005-303681. FIG. 11A is showing a graph in which the vertical axis indicates an absolute value of a signal level, and the lateral axis indicates the lapse of time. FIG. 11A shows a case that a signal A of a predetermined level is provided first, and after a gap period with no signal, a signal B of another predetermined level is provided. In such a case, the level of human audibility is schematically shown as FIG. 11B. That is, with the human audibility, after the signal A, the pattern of the signal A remains for a while although the sensitivity is reduced. This is referred to as "front (forward) masking", and if this is the case, people do not hear noise, if any, in the shaded portion of the drawing. Immediately before the signal B is provided, the hearing sensitivity is also reduced, and this is referred to as rear (backward) masking. If this is the case, people do not hear noise, if any, in the shaded portion of the drawing.

The front masking is generally larger in amount than the rear masking, and although depending on the time conditions, the masking phenomenon occurs about several hundreds of mS at the maximum. Under specific conditions, the gap period of FIG. 11A is not perceived by hearing, and the signals A and B sound as successive. Such a phenomenon is described in the research paper written by R. Plomp about gap detection (1963), the research paper written by Miura (SONY Corp. JAS. Journal 94. November), and "General Auditory Psychology" written by B. C. J. Moore, and translated by Kengo Ogushi, Seishin Books, 4th Chapter/Auditory System Time Resolution, and under the following conditions, the time of gap period not perceived by hearing is lengthened to a range of several mS to several tens of mS.

1. The gap period is lengthened when there is a correlation between the signals A and B in terms of frequency band. The gap period is also lengthened if the signals A and B show continuity with respect to their frequencies.

2. The gap period is lengthened not with a single sine wave but with a band signal.

3. When the signals A and B share the same level, the lower the levels of the signals are, the more the gap period is lengthened, and if the levels of the signals are increased beyond a specific value, the gap period shows no change.

4. The gap period is lengthened when the signal B is lower in level than the signal A.

5. The lower the center frequency in a signal is, the more the gap period is lengthened, and the higher the frequency is, the more the gap period is shortened.

As such, in the previous papers, such detection conditions for the length of the gap period are used as a basis to remove the above-described noise, i.e., shock noise, touch noise, and clock noise, without making people perceive, by hearing, the noise removal. In the below description, such conditions are referred to as masking conditions 1 to 5. In JP-A-2005-303681 (i.e., "Noise Reduction Method and Device"), the masking conditions are used as a basis to control the length of the gap period as appropriate at the time of generation of noise. The issue here is that, under conditions like shortening the length of the gap period in the masking conditions, the period of noise to be arisen may be longer than the length of the gap period to be masked in some cases, i.e., when the signals A and B are both a tone signal being close to a sine wave with the masking condition 2, when the level of the signals A and B is relatively high with the masking condition 3, or when the frequency band in the signals A and B is relatively high with the masking condition 5. In such cases, the noise removal does not work accurately for some period of the noise signal.

By referring to FIG. 12, described next is an exemplary noise reduction device of JP-A-2005-303681 (i.e., "Noise Reduction Method and Device"). In this example, the device is proposed for the aim of reducing noise to be generated by a seek operation in a disk unit, e.g., HDD (Hard Disk Drive). In the noise reduction device, information is read and written from/to a magnetic coating on the surface of a hard disk 16 using a magnetic head 15, which is attached to a VCM (Voice Coil Motor) 14. The hard disk 16 is controlled by a servo signal 11 coming from a built-in microprocessor 10 with DSP (Digital Signal Processor) in such a manner that a spindle motor 17 keeps a predetermined rotation speed. Similarly, this VCM 14 is driven by a position control signal 13 coming from the built-in microprocessor 10 with DSP (Digital Signal Processor), and the magnetic head 15 is so controlled as to read/write data from/to a predetermined position of the hard disk 16.

The noise to be generated at the seek operation is caused by the vibration of the portion of an actuator. The vibration occurs when the magnetic head 15 is rapidly accelerated or decelerated to move by the VCM 14 to the data read/write position on the disk. When the noise is generated as such, the built-in microprocessor 10 with DSP outputs a noise timing signal 12 to gap period generation means 8. A microphone 1 is any arbitrary microphone unit, and a negative output terminal of the microphone 1 is grounded to a circuit ground (GND), and a positive output terminal is connected to an amplifier (AMP) 2 so that an output signal is derived.

This output signal is supplied to one fixed contact point 4*a* of a selection switch 4, and then to the other fixed contact point 4*b* thereof via noise removal means 3. The output signal is also input to level detection means 6 so that the audio level is detected. Thus detected audio level is used as a basis for masking amount determination means 7 to determine the masking amount, and the result is forwarded to the gap period generation means 8. Based on the generation result, i.e., length of a gap period, a signal selected by the selection switch 4 is output from an output terminal 5 via a movable contact point 4*c*.

Described next is the operation of the noise reduction device of FIG. 12 example. The microphone 1 outputs a signal being a mixture of an audio signal and a noise signal from the HDD. As described above, the noise as a target is not always generated continuously but generated only with any accidental shock. Therefore, when there is no shock, the movable contact point 4*c* of the selection switch 4 is so controlled as to be connected to the fixed contact point 4*a* so that the audio signal from the microphone 1 is output as it is. If with any shock, the movable contact point 4*c* of the selection switch 4 is so controlled as to be connected to the side of the fixed contact point 4*b* only for the gap period generated by the gap period generation means 8, and the noise signal is cut off by the noise removal means 3.

If an audio signal is input at the same time, it means that the audio signal will be also cut off. In consideration thereof, the level of the audio signal is detected by the level detection means 6, and based on thus detected level, the masking amount determination means 7 and the gap period generation means 8 generate the gap period to be masked by the human sense of hearing. Thus generated gap period is then used as a basis to control the time to connect the movable contact point 4*c* of the selection switch 4 to the fixed contact point 4*b* thereof.

By referring to FIG. 13, described next is another exemplary noise reduction device of JP-A-2005-303681. In the configuration, any component similar to that of FIG. 12 example is provided with the same reference numeral. In this FIG. 13 example, target noise is touch noise or click noise, and the microphone 1 is any arbitrary microphone unit. A negative output terminal of the microphone 1 is grounded to the circuit ground (GND), and a positive output terminal is connected to the amplifier (AMP) 2 so that an output signal is derived.

As to a sensor 18, a negative output terminal is grounded to the circuit ground (GND), and a positive output terminal is connected to an amplifier (AMP) 19 so that an output signal is input to a comparator 20. The output signal is compared in level with a signal of a pre-configured REF (reference) level coming from an input terminal 9. The comparison result is forwarded from the comparator 20 to the gap period generation means 8.

The output signal coming from the amplifier 2 is supplied to the fixed contact point 4*a* of the selection switch 4, and also to the level detection means 6 so that the audio level is detected. Based on thus detected audio level, the masking amount is determined by the masking amount determination means 7, and the determination result is forwarded to the gap period generation means 8. In accordance with the length of the generated gap period, the signal selected by the selection switch 4 is output from the output terminal 5. The selection switch 4 here is the one whose fixed contact point 4*b* is grounded to the circuit ground (GND).

Described now is the operation of another exemplary noise reduction device of JP-A-2005-303681, i.e., FIG. 13 example. The microphone 1 outputs a signal being a mixture of an audio signal and a noise signal from a noise generation source. As described above, the noise being a target, i.e., touch noise or click noise, is not always generated continuously but generated only with any accidental shock. Therefore, when there is no shock, the movable contact point 4*c* of the selection switch 4 is so controlled as to be connected to the fixed contact point 4*a* so that the audio signal from the microphone 1 is output as it is. Only when any shock as a target is detected by the sensor 18, the movable contact point 4*c* of the selection switch 4 is so controlled as to be connected at this time to the side of the fixed contact point 4*b* (GND) so that the noise signal is cut off.

If an audio signal is input at this time, it means that the audio signal will be also cutoff. In consideration thereof, the level of the audio signal is detected by the level detection means 6, and based on thus detected level, the masking amount determination means 7 and the gap period generation means 8 generate the gap period to be masked by the human sense of hearing. Thus generated gap period is then used as a basis to control the time to connect the movable contact point 4*c* of the selection switch 4 to the side of the fixed contact point 4*b* (GND) thereof.

When the vibration signal provided by the sensor 18 is of the level higher than the level set by the reference level input, for example, the comparator 20 determines that some shock is currently given. When the level is lower than the reference level, the comparator 20 determines that there is currently no shock. Based on the level provided by the level detection means 6, the masking amount determination means 7 lengthens the gap period under the masking condition 3, more when the audio level is low than being high. Under the masking condition 4, the masking amount determination means 7 controls the gap generation period so that the gap period can be lengthened when the audio level is being decreased rather than being increased over a period of time.

It is thus desirable to provide an audio signal noise reduction device that is an improvement of JP-A-2005-303681, and is capable of reducing even long-lasting noise.

According to an embodiment of the invention, there is provided an audio signal noise reduction device that includes: input means for making an input of one or more audio signals; timing generation means for generating a gap period in accordance with a generation period of noise coming from a noise generation source included in the audio signal; noise removal means for removing the noise from the audio signal; level envelope detection means for continuously detecting a level envelope of the audio signal; coefficient generation means for generating a coefficient for the level envelope in the gap period in accordance with a signal level provided by the level envelope detection means; interpolation signal generation means; level modulation means for subjecting a signal from the interpolation signal generation means to level modulation using the coefficient generated by the coefficient generation means; mixing means for mixing an output from the noise removal means and an output from the level modulation means; and selection means for outputting a signal from the mixing means in a period corresponding to the gap period, and outputting the audio signal not in the gap period.

According to another embodiment of the invention, there is provided an audio signal noise reduction device that includes: input means for making an input of one or more audio signals; timing generation means for generating a gap period in accordance with a generation period of noise coming from a noise generation source included in the audio signal; noise removal means for removing the noise from the audio signal; level envelope detection means for continuously detecting a level envelope of the audio signal; masking amount determination means for determining, in accordance with a signal level provided by the level envelope detection means, a masking level for a human sense of hearing in the gap period; interpolation signal generation means; level modulation means for subjecting a signal from the interpolation signal generation means to level modulation using a coefficient generated by the masking amount determination means; mixing means for mixing an output from the noise removal means and an output from the level modulation means; and selection means for outputting a signal from the mixing means in a period corresponding to the gap period, and outputting the audio signal not in the gap period.

According to still another embodiment of the invention, there is provided an audio signal noise reduction device that includes: input means for making an input of one or more audio signals; timing generation means for generating a gap period in accordance with a generation period of noise coming from a noise generation source included in the audio signal; noise removal means for removing the noise from the audio signal; level envelope detection means for continuously detecting a level envelope of the audio signal; first coefficient generation means for generating, in accordance with a signal level provided by the level envelope detection means, a level coefficient for the level envelope in the gap period; spectrum envelope detection means for continuously detecting a frequency spectrum of the audio signal; second coefficient generation means for generating a spectrum coefficient in the gap period in accordance with spectrum information provided by the spectrum envelope detection means; interpolation signal generation means; level modulation means for subjecting a signal from the interpolation signal generation means to level modulation using the coefficient generated by the first coefficient generation means; mixing means for mixing an output from the noise removal means and an output signal from the interpolation signal generation means via the level modulation means modulating the signal using the coefficient generated by the first coefficient generation means and variable filter means that performs frequency modulation using the coefficient generated by the second coefficient generation means; and selection means for outputting a signal from the mixing means in a period corresponding to the gap period, and not in the gap period, outputting the audio signal.

According to still another embodiment of the invention, there is provided an audio signal noise reduction method that includes the steps of: generating a gap period in accordance with a generation period of noise coming from a noise generation source included in one or more incoming audio signals; detecting continuously a level envelope of the audio signal; generating a coefficient for the level envelope in accordance with a signal level being a detection result; generating an interpolation signal, and subjecting the interpolation signal to level modulation using the coefficient; mixing an output being a result of the level modulation and an output being a result of removing the noise from the audio signal; and outputting a signal being a mixing result in a period corresponding to the gap period, and not in the gap period, outputting the audio signal as it is.

According to still another embodiment of the invention, there is provided an audio signal noise reduction method that includes the steps of: generating a gap period in accordance with a generation period of noise coming from a noise generation source included in one or more incoming audio signals; detecting continuously a level envelope of the audio signal; determining, using a signal level being a detection result, a masking level for a human sense of hearing in the gap period; generating an interpolation signal, and subjecting the interpolation signal to level modulation using a coefficient generated by the masking level determination; mixing an output being a result of the level modulation and an output being a result of removing the noise from the audio signal; and outputting a signal being a mixing result in a period corresponding to the gap period, and not in the gap period, outputting the audio signal as it is.

According to still another embodiment of the invention, there is provided an audio signal noise reduction method that includes the steps of: generating a gap period in accordance with a generation period of noise coming from a noise generation source included in one or more incoming audio signals; detecting continuously a level envelope of the audio signal; generating a level coefficient for the level envelope in accordance with a signal level being a detection result; detecting continuously a frequency spectrum of the audio signal; generating a spectrum coefficient in the gap period in accordance with spectrum information being a detection result; generating an interpolation signal, and subjecting the interpolation signal to level modulation using the level coefficient and to frequency modulation using the spectrum coefficient; mixing an output being a result of the level modulation and an output being a result of removing the noise from the audio signal; and outputting a signal being a mixing result in a period corresponding to the gap period, and not in the gap period, outputting the audio signal as it is.

In the embodiments of the invention, a gap period is subjected to level-envelope interpolation using a signal independently generated so that any long-lasting noise can be reduced.

In the embodiments of the invention, in consideration of time masking being a part of a masking phenomenon observed in the human sense of hearing, any segment of the gap period not to be masked is interpolated so that any long-lasting noise can be reduced.

In the embodiments of the invention, an interpolation signal in the gap period is not only modulated in level but also changed in frequency characteristics so that the signal continuity can be retained, and the masking effects can be increased to a further degree.

BRIEF DESCRIPTION OF THE DRAWINGS

FIG. 2 is a diagram for use to describe the embodiment of the invention;

FIG. 3 is a diagram showing the configuration of an exemplary interpolation signal generator;

FIGS. 4A to 4C are all a diagram for use to describe the embodiment of the invention;

FIG. 8 is a diagram for use to describe the embodiment of the invention;

FIGS. 9A to 9C are all a diagram for use to describe the embodiment of the invention;

DESCRIPTION OF PREFERRED EMBODIMENTS

Figure 1:
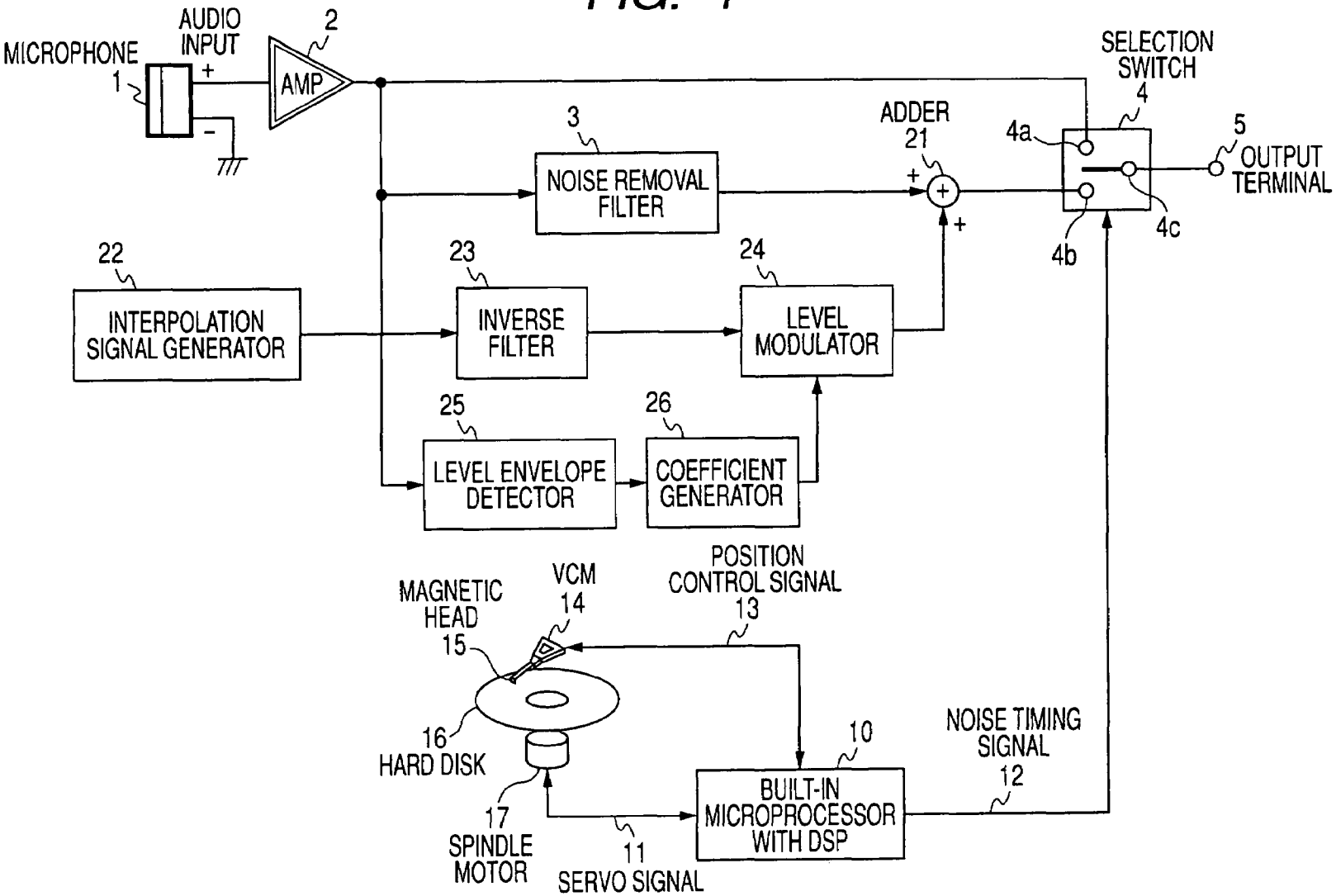
FIG. 1 is a diagram showing the configuration of an exemplary best embodiment of the invention for a practical use of an audio signal noise reduction device.

In the below, described is an exemplary best embodiment of the invention for a practical use of an audio signal noise reduction device and method by referring to the accompanying drawings. In FIG. 1, any component corresponding to that in FIG. 12 is provided with the same reference numeral, and not described in detail again.

Figure 12:
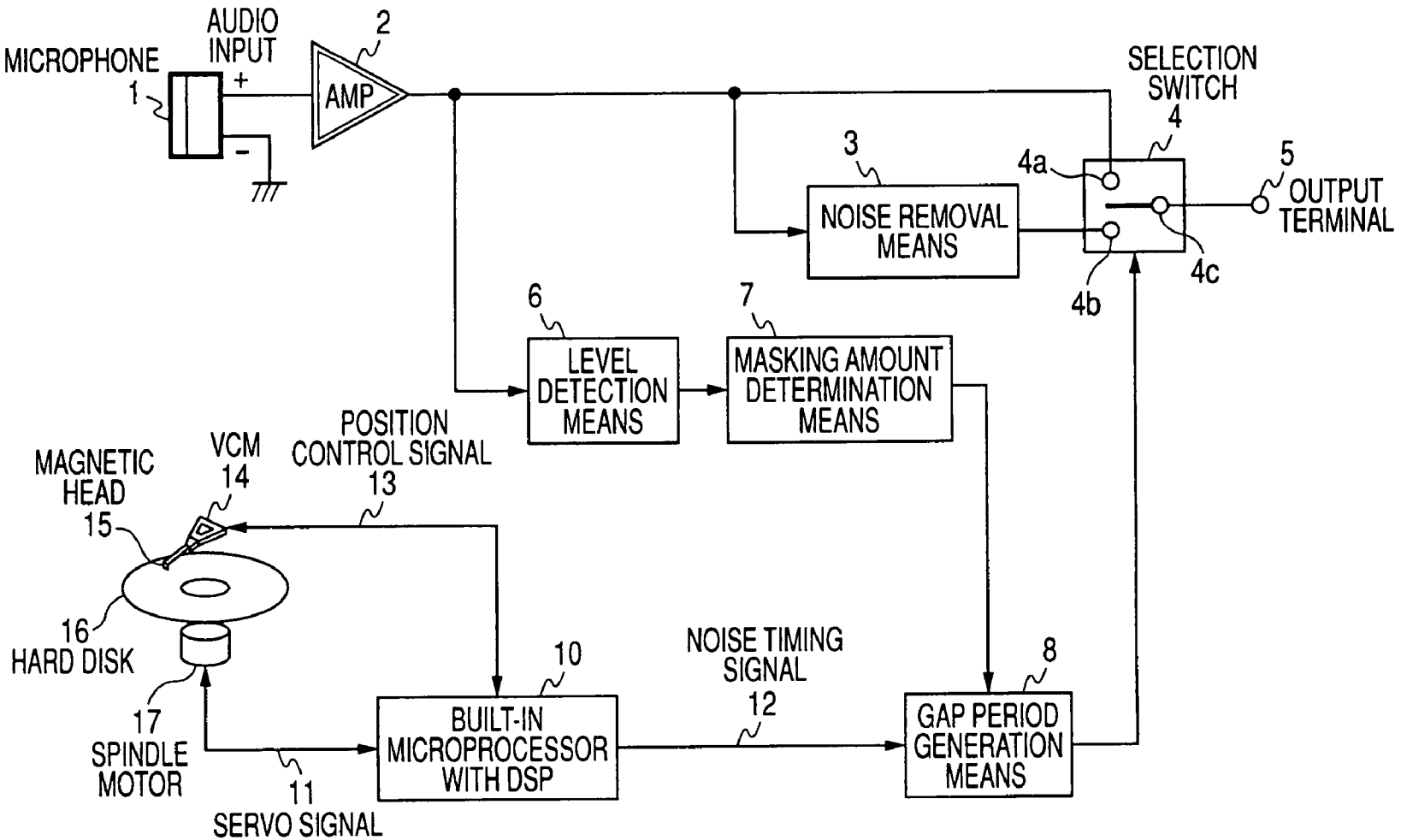
FIG. 12 is a diagram showing the configuration of an exemplary audio signal noise reduction device.

In FIG. 1 example, similarly to FIG. 12 example, the noise timing signal 12 is generated by the built-in HDD-controlling microprocessor 10 with DSP, and serves as a control signal for the selection switch 4 as it is. At the time of a seek operation, the noise timing signal 12 works to control the movable contact point 4*c* of the selection switch 4 to be connected to the fixed contact point 4*b* thereof, and to select a signal coming from an adder 21. In the other timing, the noise timing signal 12 works to control the movable contact point 4*c* of the selection switch 4 to be connected to the fixed contact point 4*a* thereof, and to select an audio signal coming from the microphone 1. Thus selected audio signal is output from the output terminal 5. As such, no control is carried out over the gap period like in FIG. 12 example.

A noise removal filter 3 is configured by a filter such as BEF (Band Elimination Filter) to attenuate every band including any noise. One or more bands are configured as a target for the BEF. If with an HDD, any vibration of the portion of an actuator occurring when the magnetic head 15 is rapidly accelerated or decelerated to move during the seek operation is checked in advance to see its frequency distribution. The BEF is so set as to filter the frequency band of the vibration noise. Alternatively, the BEF may be provided as a plural to be ready for various modes in accordance with any change characteristics, i.e., seek profile, when the actuator is accelerated or decelerated to move.

Although not shown, for a seek operation in an optical disk unit such as DVD (Digital Versatile Disc), the BEF configuring as the noise removal filter 3 is so set as to filter any band including vibration noise of a tracking motor or others moving a pickup.

Considered here is a case that the noise frequency band is completely cut off by the noise removal filter 3. If this is the case, the audio signal in the band is also removed at the same time, thereby causing a problem that the gap period is possibly sensed by hearing. In consideration thereof, in JP-A-2005-303681, the gap period is suppressed to a range over which the masking effects can serve well for the human sense of hearing so that the noise reduction is carried out.

The concern here is that, with some length of the noise period generated, the length of the noise period becomes longer than the gap period to be masked, thereby causing a problem of not being able to completely remove every period of the noise signal. Accordingly, in this embodiment, an interpolation signal is generated in the gap period for addition in the adder 21 for the aim of increasing the masking effects for human audibility.

By referring to FIG. 2, described now is exemplary signal interpolation for a gap period. In this example, a level envelope is formed to keep the level continuity of the signals A and B in the gap period. As indicated by the shaded portion, an interpolation signal is generated in the gap period for addition in the adder 21 so as to make no gap audible for the human sense of hearing.

That is, in FIG. 1 example, an interpolation signal is generated by an interpolation signal generator 22 that will be described later, and the resulting signal is passed through an inverse filter 23. The inverse filter 23 has the inverse filter characteristics of the noise removal filter 3, i.e., characteristics that its pass band is a rejection band of the noise removal filter 3, and its rejection band is the pass band of the noise removal filter. After passing through such an inverse filter 23, the signal is input to the adder 21 after being modulated in level by a level modulator 24. With respect to an incoming signal from the microphone 1, a level envelope is continuously detected by a level envelope detector 25. Based on the level detected as such, in a coefficient generator 26, a level modulation coefficient is continuously generated like the interpolation signal of FIG. 2 in the gap period using the level modulator 24.

By referring to FIG. 3, the interpolation signal generator 22 is described. In this example, an output signal from a tone signal generator 41 and an output signal from an M-sequence signal generator 42 are mixed together at a predetermined ratio in a mixer 43, and the resulting signal is output from an output terminal 44 to make it serve as an interpolation signal. Herein, the tone signal generator 41 generates a signal configured by one or more sine waves or pulse waves of a predetermined cycle, and the M-sequence signal generator 42 generates a level-uniform white noise signal over the entire voice band.

The reason of such signal mixing is that a general audio signal is configured by a tone signal and a random signal. The tone signal has the frequency characteristics showing one or more peaks in a predetermined frequency, and the random signal has the frequency characteristics showing relative flatness. The mixing ratio for use by the mixer 43 is optimized as appropriate in consideration of the noise removal band characteristics of the noise removal filter 3. Alternatively, either the tone signal or the random signal may be set to 0 for the mixing ratio, e.g., only the random signal from the M-sequence signal generator 42 may be used.

By referring to FIGS. 4A to 4C, described next is exemplary envelope detection by the level envelope detector 25. First of all, any arbitrary input waveform of FIG. 4A is rectified as shown in FIG. 4B. Thereafter, any low-frequency component is extracted using a low-pass filter (LPF) or others for smoothing, and a level envelope of the input signal level is detected as the thick line of FIG. 4C. In FIG. 1 example, any instantaneous noise signal in the gap period included in the audio signal is also subjected to envelope detection. In this example, however, with the process of smoothing, any abrupt level change such as instantaneous noise is hardly subjected to the envelope detection because of behavior of the low-pass filter (LPF).

Note that the selection switch 4 of FIG. 1 example may be replaced by a cross-fading switch that will be described by referring to FIGS. 5A to 5C. In the block diagram of FIG. 5A, a THR input terminal 31 corresponds to the fixed contact point 4*a* of the selection switch 4, and a COM input terminal 32 corresponds to the fixed contact point 4*b* of the selection switch 4. The signals are mixed together in an adder 37 via an attenuator (hereinafter, referred to as ATT) 34 and another ATT 35, both of which are each configured by a multiplier or others. The mixing result is output from an output terminal 38. The noise timing signal 12 comes from the input terminal 33, a control coefficient is generated for the ATT 34 by a control coefficient generation circuit 39, and the ATT 35 is controlled via a coefficient inversion circuit 36. If with exemplary timing control as in FIGS. 5B and 5C, with a control coefficient with which the THR signal is generated by the control coefficient generation circuit 39, an output is changed by the ATT 34 using a predetermined time constant. At the same time, when the ATT 35 is controlled by a control coefficient having the characteristics inverted by the coefficient inversion circuit 36, the output is changed, as the solid line and the dotted line in the drawing, so as to cross-fade with a predetermined time constant. Accordingly, no overshoot or ringing occurs, and the waveform non-continuity between the THR signal and the COM signal derived when the signals are switched is absorbed for human audibility. This thus serves advantageous for the masking effects. The signal interpolation at this time is shown in FIG. 6 as exemplary signal interpolation.

Figure 7:
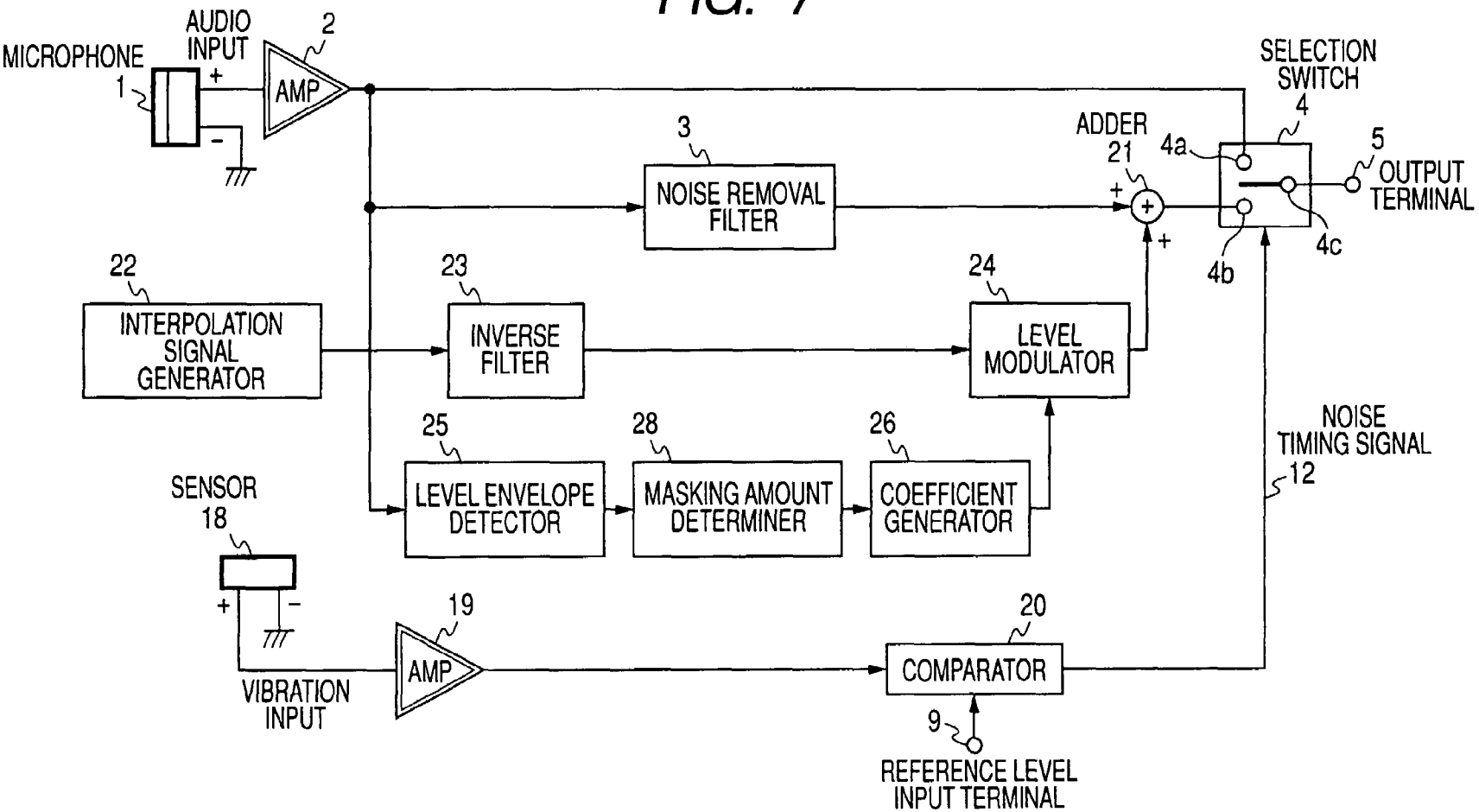
FIG. 7 is a diagram showing the configuration of another exemplary best embodiment of the invention for a practical use of an audio signal noise reduction device.
Figure 13:
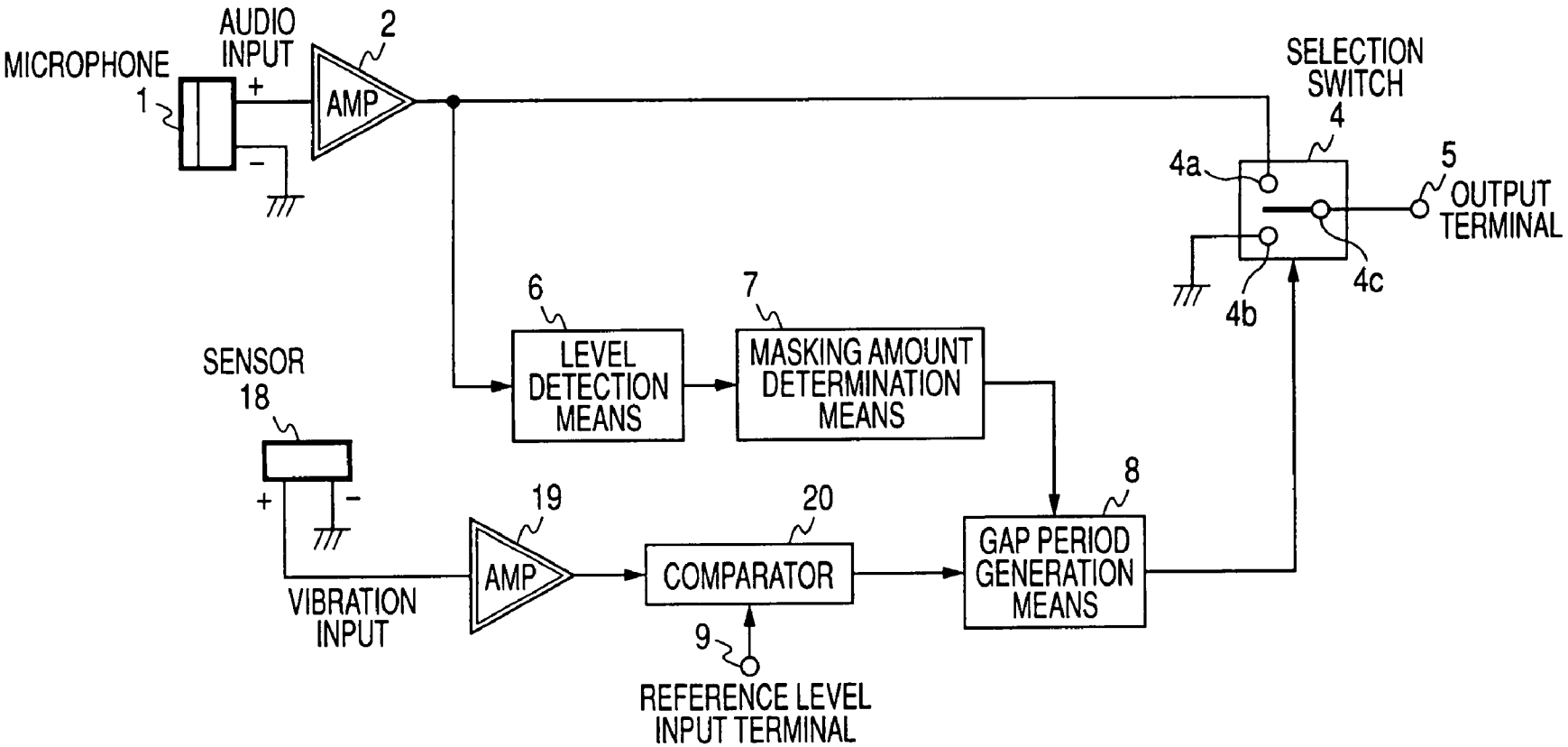
FIG. 13 is a diagram showing the configuration of another exemplary audio signal noise reduction device.

By referring to FIG. 7, described next is another exemplary best embodiment of the invention for a practical use of the audio signal noise reduction device. In FIG. 7, any component corresponding to that in FIG. 13 is provided with the same reference numeral, and not described in detail again. In FIG. 7, the microphone 1 outputs a signal being a mixture of an audio signal and a noise signal from a noise generation source. Similarly to FIG. 13 example, when there is no shock, the movable contact point 4*c* of the selection switch 4 is so controlled as to be connected to the fixed contact point 4*a* thereof so that the audio signal from the microphone 1 is output as it is. Only when any target shock is detected by the sensor 18, the movable contact point 4*c* of the selection switch 4 is so controlled as to be connected to the fixed contact point 4*b* thereof so that the noise signal is cut off.

If an audio signal is input also at the same time, it means that the audio signal will be also cut off. In consideration thereof, the level of the audio signal is continuously detected by the level envelope detector 25, and based on thus detected level, a masking amount determiner 28 determines the masking amount to be masked by the sense of human hearing. In accordance with the masking amount, the coefficient generator 26 generates a level coefficient for use to subject an interpolation signal to level modulation by the level modulator 24, and the result is output to the adder 21. Herein, the interpolation signal is the one to be generated by the interpolation signal generator 22 and the inverse filter 23, both of which are configured similarly to those in FIG. 1 example.

Figure 11A:
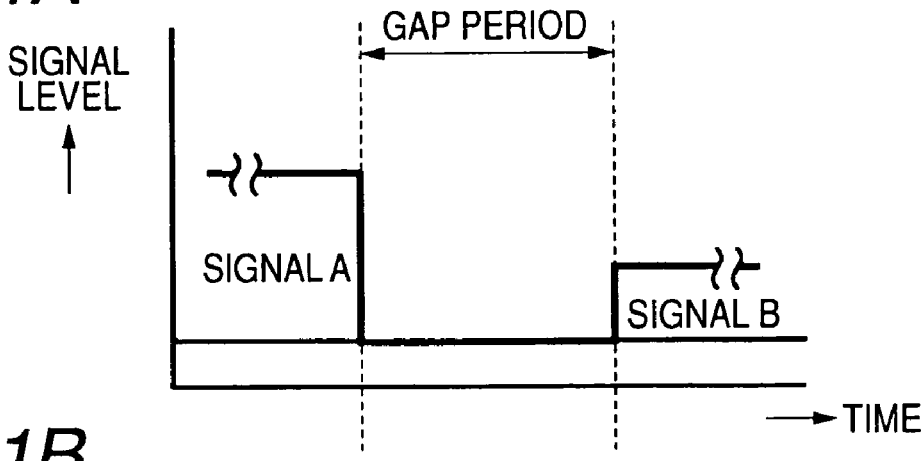
FIGS. 11A and 11B are both a diagram for use to describe the embodiment of the invention.
Figure 11B:
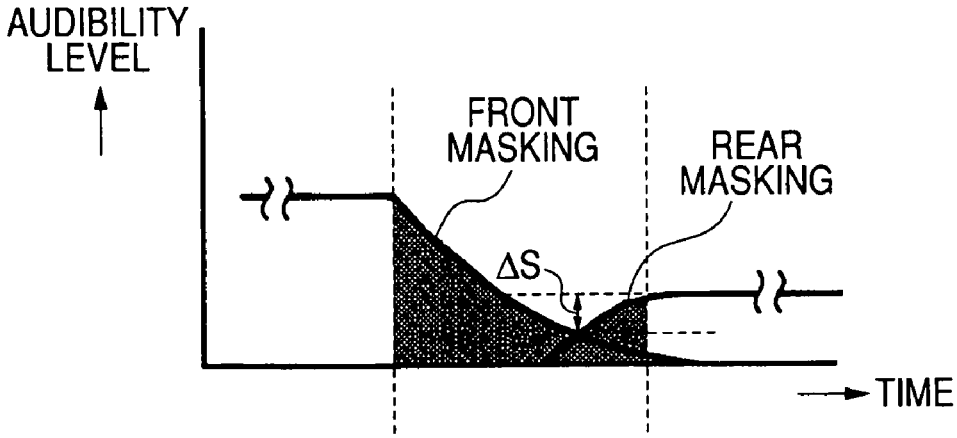

By referring to FIG. 8, described now is exemplary signal interpolation of the gap period in FIG. 7. As shown in FIG. 8, in FIG. 7 example, taking into consideration the masking effects for the audibility level shown in FIG. 11, any insufficient portion in the gap period for the audibility level (ΔS of FIG. 11) is interpolated by any other signal. For example, an interpolation signal is generated as in the shaded portion of the gap period in FIG. 8 for addition in the adder 21 so that no gap is captured by the human audibility. Moreover, in FIG. 8, there is no need to keep the level continuity between the signals A and B as in FIG. 2, and level interpolation is performed to achieve masking of the gap period for human audibility.

Figure 5A:
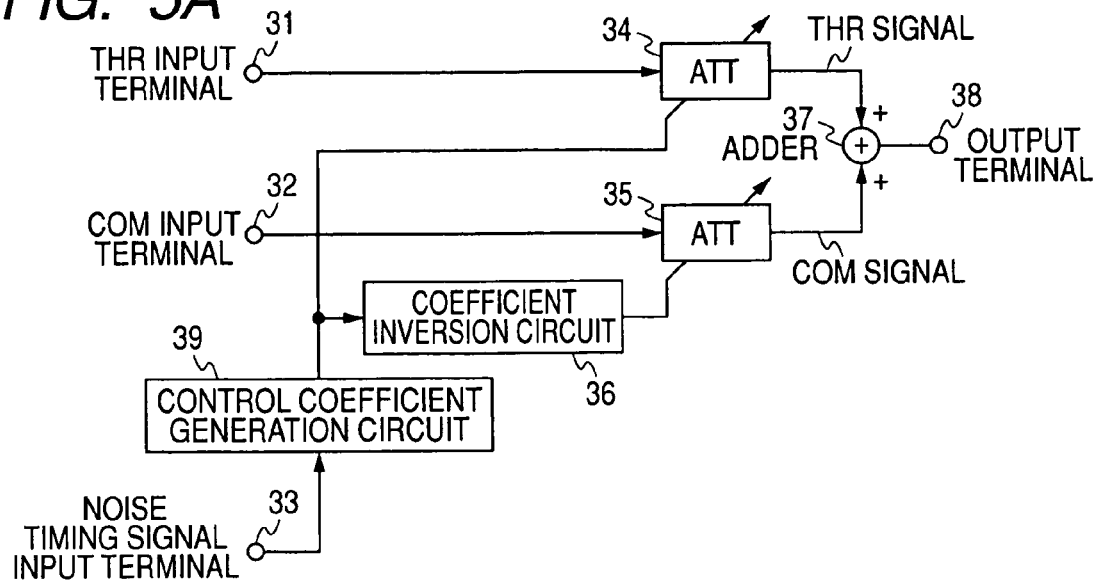
FIG. 5A is a diagram showing the configuration of an exemplary cross-fading switch.
Figure 5B:
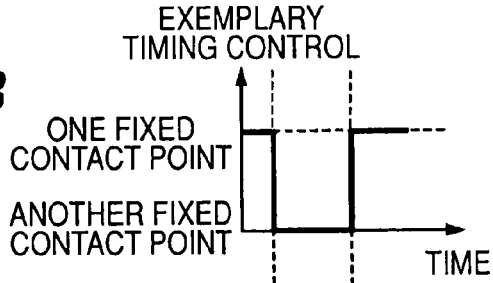
FIGS. 5B and 5C are both a diagram for use to describe an oscillation frequency.
Figure 5C:
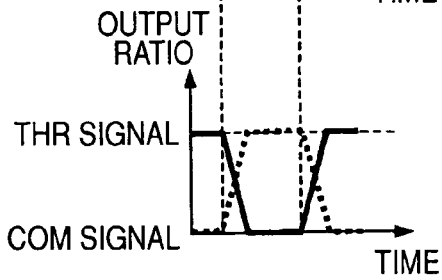
Figure 6:
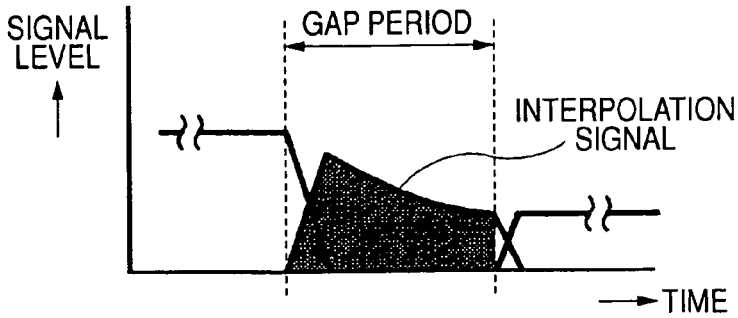
FIG. 6 is a diagram for use to describe the embodiment of the invention.

Note that, similarly to FIG. 1 example, the selection switch 4 of FIG. 7 may be replaced by the cross-fading switch described by referring to FIGS. 5A to 5C.

By referring to FIGS. 9A to 9C, described now is the operation of the audio signal noise reduction device of FIG. 7 example. FIG. 9A shows an exemplary target noise signal, and such a shock noise signal as shown in the drawing is provided by the microphone 1. At the same time, if the sensor 18 detects any shock noise as in FIG. 9B, the comparator 20 compares the level of the detection result with the reference level provided by the input terminal 9. As shown in FIG. 9C, any timing period showing the higher level than the reference level is set as a noise removal period, and is supplied as the noise timing signal 12 to the selection switch 4 so that an interpolation signal is inserted.

Figure 10:
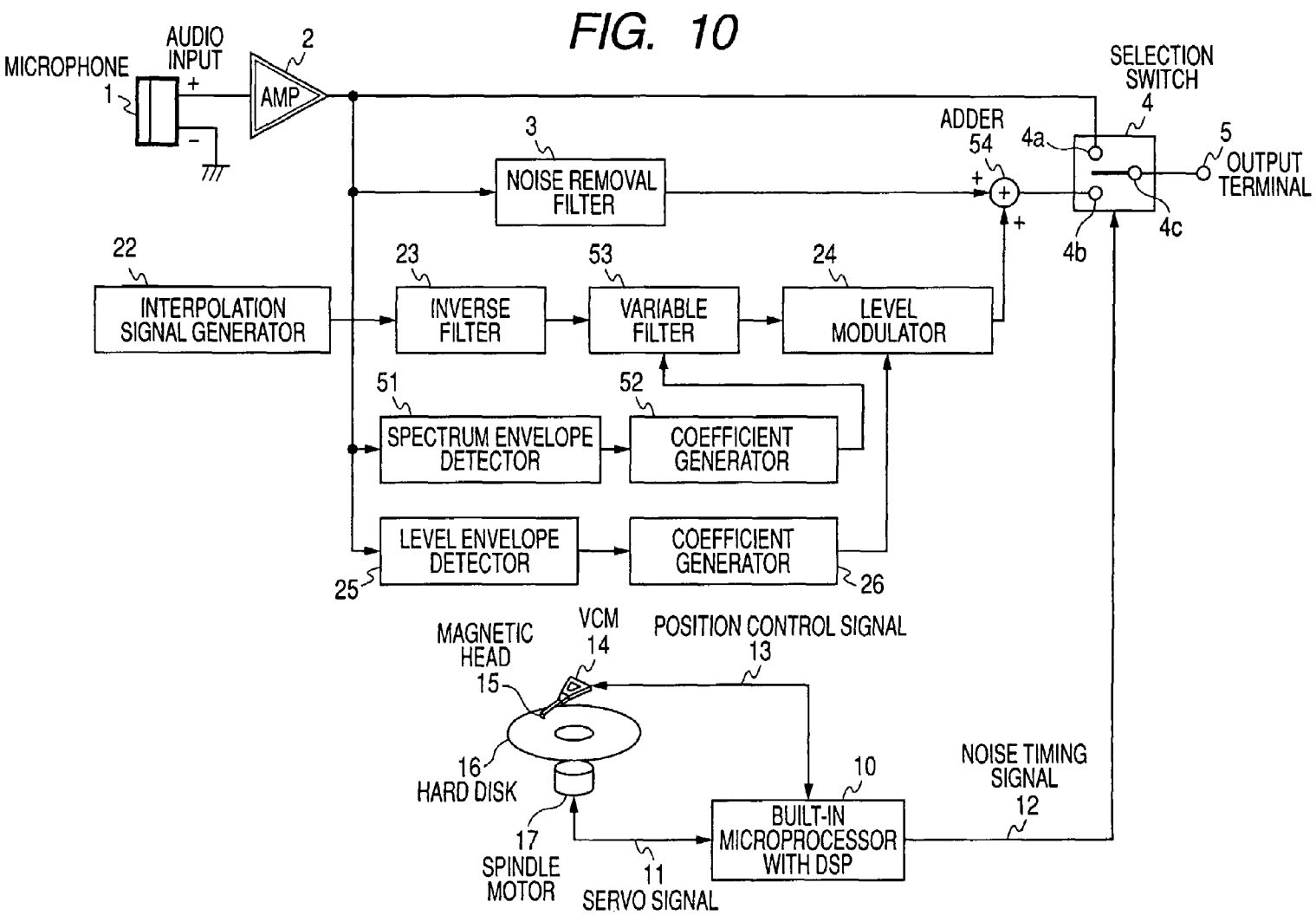
FIG. 10 is a diagram showing the configuration of still another exemplary best embodiment of the invention for a practical use of an audio signal noise reduction device.

By referring to FIG. 10, described next is still another exemplary best embodiment of the invention for a practical use of the audio signal noise reduction device. In FIG. 10, any component corresponding to that in FIGS. 1 and 7 is provided with the same reference numeral, and not described in detail again.

In FIGS. 1 and 7 examples, in consideration of the above-described masking conditions 3 and 4, the gap period is subjected to level modulation using an interpolation signal in such a manner as to satisfy the continuity in the level direction. In FIG. 10 example, in consideration of the masking condition 1 in addition to the masking conditions 3 and 4, the gap period is subjected to frequency modulation using an interpolation signal in such a manner as to satisfy the continuity in the frequency direction. This can favorably increase the masking effects to a further degree.

Similarly to FIG. 12 example, the noise timing signal 12 is generated by the built-in HDD-controlling microprocessor 10 with DSP, and serves as a control signal for the selection switch 4 as it is. At the time of a seek operation, the noise timing signal 12 works to control the movable contact point 4*c* of the selection switch 4 to be connected to the fixed contact point 4*b* thereof, and to select a signal coming from an adder 54. In other cases, the noise timing signal 12 works to control the movable contact point 4*c* of the selection switch 4 to be connected to the fixed contact point 4*a* thereof, and to select an audio signal coming from the microphone 1. Thus selected audio signal is output from the output terminal 5.

The noise removal filter 3 is configured similarly to FIG. 1 example to filter every band including any noise. Similarly, an interpolation signal from the interpolation signal generator 22 and the inverse filter 23 whose filter characteristics are inverse to those of the noise removal filter 3 is added by the adder 54 via a variable filter 53 and the level modulator 24, which are not limited in order for processing. Herein, similarly to FIG. 1 example, the level modulator 24 continuously detects a level envelope using a coefficient to be generated by the level envelope detector 25 and the coefficient generator 26, and the gap period is continuously subjected to level modulation like an interpolation signal of FIG. 2.

For continuously detecting a frequency spectrum of an incoming signal, a spectrum envelope detector 51 detects the level of the incoming signal for every frequency by a fast Fourier transformer (FFT) or a plurality piece of band dividers. A coefficient generator 52 then generates a filter coefficient so as to reproduce the detected frequency spectrum in the variable filter 53. The gap period is thus continuously interpolated not only by level but also by frequency component so that the masking effects can be increased to a further extent. Alternatively, the level envelope detector 25 and the coefficient generator 26 may be replaced by the level envelope detector 25 and the masking amount determiner 28 of FIG. 7, respectively, and the level may be interpolated as in FIG. 8. Still alternatively, the selection switch 4 may be replaced by the cross-fading switch of FIGS. 5A to 5C.

JP-A-2005-303681 (i.e., "Noise Reduction Method and Device") is simply a noise reduction method in which only a noise generation period is gated utilizing the masking phenomenon observed in the sense of human hearing. In this embodiment, the gap period is subjected to level-envelope interpolation using a signal independently generated so that any long-lasting noise can be also reduced.

Also in this embodiment, in consideration of time-masking being a part of a masking phenomenon observed in the human sense of hearing, any segment of the gap period not to be masked is interpolated so that any long-lasting noise can be reduced.

Further, this embodiment serves effective to remove any click noise and shock noise generally included in an audio signal, especially effective to remove any noise generated in small-sized equipment including therein a microphone, for example.

In this embodiment, a sensor is utilized to detect a noise generation period, and extract any period showing a high noise level. If such a sensor is disposed in the vicinity of a noise generation source, the noise detection can be completed with ease, and if the sensor is provided as a plural, the detection can be done with higher accuracy. If the reference level is adjusted in the comparator, any timing showing the highest noise level can be detected and removed so that the effects of noise removal can be increased even if with a short gap period.

In this embodiment, when the noise generation source is under the control of the microprocessor or others as a seek noise coming from a disk unit, for example, noise timing information exists in advance. Therefore, even if the sensor or others are not used, it can be realized to confine the noise generation period with ease.

In this embodiment, even if any noise band of the gap period is removed using a filter or others, and the audio signal with the noise is completely removed, no problem occurs because the gap period is interpolated in such a manner as to be masked for human audibility. What is more, any band signal other than the noise band is provided with the continuity before and after the gap period so that the gap period to be masked can be advantageously lengthened.

In this embodiment, the audio signal is deemed a result of mixture of a plurality of sine waves. For reproduction of such an audio signal, a periodic signal and a random signal are mixed together repeatedly, thereby enabling to generate the signal with relative ease. Also in this example, the audio signal is not aimed to be reproduced with fidelity, and signal interpolation is performed only to make up for a shortage in the gap period and satisfy the masking conditions.

In this embodiment, since no overshoot or ringing occurs at the time of switching between a normal period and a gap period, and band-broadening because of any harmonic noise does not occur, the masking effects serve advantageously.

In this embodiment, an interpolation signal in the gap period is not only modulated in level but also changed in frequency characteristics so that the signal continuity can be better kept, and the masking effects can be increased to a further degree.

Exemplified in the above embodiments is a case with a single channel with a single microphone. This is surely not restrictive, and it will be easily understood that two or more channels will also do.

While the invention has been described in detail, it is understood that numerous other modifications and variations can be surely devised without departing from the scope of the invention.

It should be understood by those skilled in the art that various modifications, combinations, sub-combinations, and alterations may occur depending on design requirements and the other factors insofar as they are within the scope of the appended claims or the equivalents thereof.

What is claimed is:

1. An audio signal noise reduction device, comprising:

input means for making an input of one or more audio signals;

timing generation means for generating a gap period in accordance with a generation period of noise coming from a noise generation source included in the audio signal;

noise removal means for removing the noise from the audio signal;

level envelope detection means for continuously detecting a level envelope of the audio signal;

coefficient generation means for generating a coefficient for the level envelope in the gap period in accordance with a signal level provided by the level envelope detection means;

interpolation signal generation means;

level modulation means for subjecting a signal from the interpolation signal generation means to level modulation using the coefficient generated by the coefficient generation means;

mixing means for mixing an output from the noise removal means and an output from the level modulation means; and selection means for outputting a signal from the mixing means in a period corresponding to the gap period, and not in the gap period, outputting the audio signal.

2. The audio signal noise reduction device according to claim 1, wherein the audio signal is captured by a microphone.

3. The audio signal noise reduction device according to claim 1, wherein the timing generation means sets, as the noise generation period, a period in which a noise detection signal derived by a sensor is of a predetermined level or more.

4. The audio signal noise reduction device according to claim 1, wherein the timing generation means generates the gap period from the noise generation period based on a drive signal that drives the noise generation source.

5. The audio signal noise reduction device according to claim 1, wherein the selection means performs cross-fading.

6. The audio signal noise reduction device according to claim 1, wherein the noise removal means is configured by a filter that removes a noise band.

7. The audio signal noise reduction device according to claim 6, wherein the interpolation signal generation means generates a signal by filtering, via the filter whose pass band is a reject band of the noise removal means, a single or plurality of periodic signals of a predetermined waveform and a predetermined cycle, a random signal being uniform in level over a voice band, or a signal being a mixture of the periodic signal and the random signal at a predetermined ratio.

8. An audio signal noise reduction device, comprising:

input means for making an input of one or more audio signals;

timing generation means for generating a gap period in accordance with a generation period of noise coming from a noise generation source included in the audio signal;

noise removal means for removing the noise from the audio signal;

level envelope detection means for continuously detecting a level envelope of the audio signal;

masking amount determination means for determining, in accordance with a signal level provided by the level envelope detection means, a masking level for a human sense of hearing in the gap period;

interpolation signal generation means;

level modulation means for subjecting a signal from the interpolation signal generation means to level modulation using a coefficient generated by the masking amount determination means;

mixing means for mixing an output from the noise removal means and an output from the level modulation means; and selection means for outputting a signal from the mixing means in a period corresponding to the gap period, and not in the gap period, outputting the audio signal.

9. An audio signal noise reduction device, comprising:

input means for making an input of one or more audio signals;

timing generation means for generating a gap period in accordance with a generation period of noise coming from a noise generation source included in the audio signal;

noise removal means for removing the noise from the audio signal;

level envelope detection means for continuously detecting a level envelope of the audio signal;

first coefficient generation means for generating, in accordance with a signal level provided by the level envelope detection means, a level coefficient for the level envelope in the gap period;

spectrum envelope detection means for continuously detecting a frequency spectrum of the audio signal;

second coefficient generation means for generating a spectrum coefficient in the gap period in accordance with spectrum information provided by the spectrum envelope detection means;

interpolation signal generation means;

level modulation means for subjecting a signal from the interpolation signal generation means to level modulation using the coefficient generated by the first coefficient generation means;

mixing means for mixing an output from the noise removal means and an output from the interpolation signal generation means via the level modulation means and variable filter means that performs frequency modulation using the coefficient generated by the second coefficient generation means; and selection means for outputting a signal from the mixing means in a period corresponding to the gap period, and not in the gap period, outputting the audio signal.

10. An audio signal noise reduction method, comprising the steps of:

generating a gap period in accordance with a generation period of noise coming from a noise generation source included in one or more incoming audio signals;

detecting continuously, by a level detector, a level envelope of the audio signal;

generating a coefficient for the level envelope in accordance with a signal level resulting from said detection;

generating, by an interpolator means, an interpolation signal, and subjecting the interpolation signal to level modulation using the coefficient;

mixing, by a mixing means, an output resulting from the level modulation and an output resulting from removal of the noise from the audio signal; and outputting in a period corresponding to the gap period a signal resulting from the mixing, and outputting the audio signal as it is in a period that is not the gap period.

11. An audio signal noise reduction method, comprising the steps of:

generating a gap period in accordance with a generation period of noise coming from a noise generation source included in one or more incoming audio signals;

detecting continuously, by a level detector, a level envelope of the audio signal;

determining, as a result of the level detection, a masking level for a human sense of hearing in the gap period;

generating, by an interpolator means, an interpolation signal, and subjecting the interpolation signal to level modulation using a coefficient generated by the determined masking level;

mixing, by a mixing means, an output resulting from the level modulation and an output resulting from removal of the noise from the audio signal; and outputting in a period corresponding to the gap period a signal resulting from the mixing, and outputting the audio signal as it is in a period that is not the gap period.

12. An audio signal noise reduction method, comprising the steps of:

generating a gap period in accordance with a generation period of noise coming from a noise generation source included in one or more incoming audio signals;

detecting continuously, by a level detector, a level envelope of the audio signal;

generating a level coefficient for the level envelope in accordance with a signal level resulting from said detection;

detecting continuously a frequency spectrum of the audio signal;

generating a spectrum coefficient in the gap period in accordance with spectrum information resulting from said frequency spectrum detection;

generating, by an interpolator means, an interpolation signal, and subjecting the interpolation signal to level modulation using the level coefficient and to frequency modulation using the spectrum coefficient;

mixing, by a mixing means, an output resulting from the level modulation and an output resulting from removal of the noise from the audio signal; and outputting in a period corresponding to the gap period a signal resulting from the mixing, and outputting the audio signal as it is in a period that is not the gap period.

* * * * *